United States Patent [19]

de Bree

[11] 3,938,908

[45] Feb. 17, 1976

[54] PUMP

[75] Inventor: Siegfried Emilius Maria de Bree, Rotterdam, Netherlands

[73] Assignee: N.V. Industrieele Handelscombinatie Holland, Rotterdam, Netherlands

[22] Filed: Oct. 10, 1974

[21] Appl. No.: 513,925

Related U.S. Application Data

[63] Continuation of Ser. No. 340,741, March 13, 1973, abandoned.

[30] Foreign Application Priority Data

Mar. 16, 1972 Netherlands ..... 7203503

[52] U.S. Cl. ..... 415/196; 415/200

[51] Int. Cl.[2] ..... F04D 7/00; F04D 7/02

[58] Field of Search ..... 415/196, 197, 200

[56] References Cited

UNITED STATES PATENTS

| | | | |
|---|---|---|---|
| 2,382,839 | 8/1945 | Wuensch | 415/197 |
| 2,433,589 | 12/1947 | Adams | 415/196 |
| 2,800,084 | 7/1957 | Butler | 415/196 |
| 2,973,716 | 3/1961 | Thomas | 415/196 |
| 3,149,574 | 9/1964 | Mill | 415/197 |
| 3,776,660 | 12/1973 | Anderson et al. | 415/212 |

FOREIGN PATENTS OR APPLICATIONS

| | | | |
|---|---|---|---|
| 27,255 | 1913 | United Kingdom | 415/196 |
| 372,059 | 5/1932 | United Kingdom | 415/196 |
| 541,973 | 12/1941 | United Kingdom | 415/196 |
| 802,529 | 6/1936 | France | 415/196 |
| 1,012,183 | 7/1957 | Germany | 415/196 |

*Primary Examiner*—Henry F. Raduazo
*Attorney, Agent, or Firm*—Young & Thompson

[57] ABSTRACT

A pump has an outer casing, an inner casing and a rotor within the inner casing. The inner casing is of brittle material of substantially U-shaped cross-sectional configuration with the legs of the U extending into sealed axially sliding contact each with one of a pair of covers between which the rotor is disposed. A pump is provided to introduce a fluid under pressure between the inner and outer casings thereby to place the inner casing in compression to prestress the inner casing in opposition to fluid pressure peaks within the inner casing.

2 Claims, 1 Drawing Figure

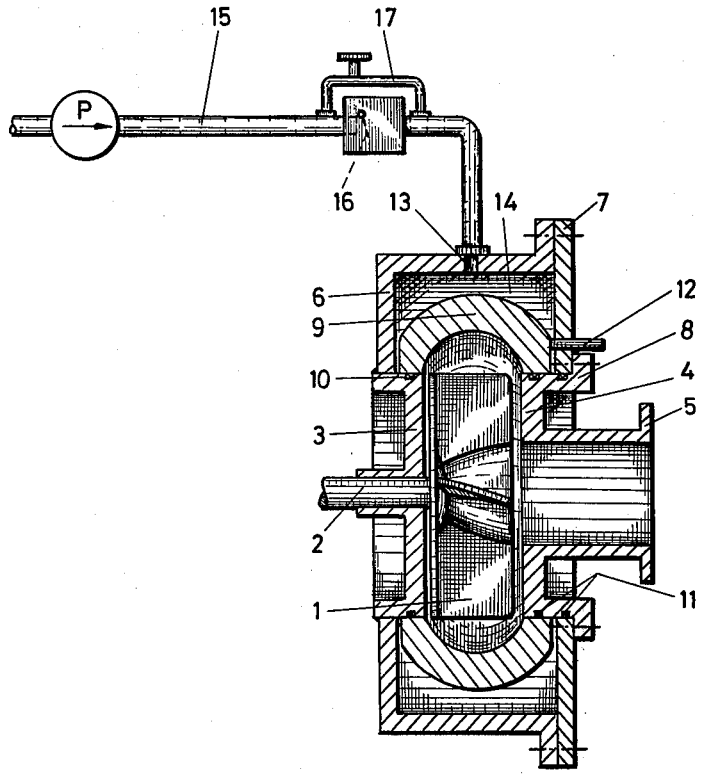
15
17
P
16
13
14
7
6
12
9
8
10
4
5
3
2
11
1

PUMP

This is a continuation of application Ser. No. 340,741, filed Mar. 13, 1973, now abandoned. The present invention relates to a pump with a double pump casing. Pumps of this kind are known and the removable inner casing usually consists of very hard material, e.g. hardened steel, in order to limit wear. With said pumps the inner casing is rigidly but not sealingly connected to the outer casing. The spaces between the inner and outer casing are in open communication with the interior of the pump.

In consequence thereof, the stresses in the hard material are uncertain due to internal- and external forces. Hard material is brittle, whereby it cannot adapt itself to the situation by yielding. It is thereby also less suitable for taking pressure surges. Pressure surges may occur however in various applications, particularly with dredging pumps in the field of dredging.

The object of the invention is to provide a pump which is more suitable for taking pressure surges.

In accordance with the invention, said object is achieved in that the inner- and outer casing are relatively movable in the axial direction, at least unidirectionally and that the inner casing has been pre-stressed by external forces, said pre-stress being opposed to the stress resulting from the internal pressure. The axial movability realizes the disconnection as it were of the inner- and outer casing. In other words, there is no longer a fastening between the inner- and outer casing, which might affect the stress behaviour in an upredictable manner. By the pre-stress which is now given to this disconnected inner casing it is not only achieved that said casing can resist higher normal internal pressures but also that the range of deformation is wider before rupture occurs, as a result of which internal pressure surges can be borne in a better way.

The desired pre-stress can be achieved in various ways. In accordance with the invention, it is thus possible to seal the spaces between the inner- and outer casing and to bring said spaces into communication with a source of fluid of constant pressure. It is possible to provide a non-return valve with a bypass with controllable throttle passage in the supply pipe of the pressure fluid. It is thus achieved that fast deformations of the inner casing are transmitted directly to the outer casing via the pressure fluid. By the fact that the inner- and outer casing have been disconnected from each other but have been sealed relative to each other, the pre-stress is not affected by any fastening to the outer casing.

It is also possible to create the pre-stress by means of pressure elements, such as springs, provided at regular distances on the circumference of the inner casing. A combination of mechanical and hydraulic means is also conceivable.

It is known with centrifugal pumps to use separate diffusers, shaft- and suction covers; the impeller shaft is supported in the shaft cover, the suction pipe connects to the suction cover and the diffuser is provided around both covers. If this way of construction is used in the pump according to the invention, the inner diffuser is preferably connected with the covers in a sealing, movable manner.

The invention will now be explained more in detail with reference to the accompanying drawing, illustrating a diagrammatic section of an embodiment of the pump in accordance with the invention.

The drawing illustrates a centrifugal pump with impeller 1 on shaft 2, said shaft being supported in a shaft cover 3, suction cover 4 with flange 5 for connection to the suction pipe. An outer casing 6 is secured to the shaft cover 3, said casing being completed with a plate 7 which is secured in a sealing manner on the suction cover 4 at the region of flange 8.

The inner casing 9 being a casting and having the known diffuser shape (not illustrated) is provided on shaft cover 3 and suction cover 4 and can be moved in the axial direction; moreover, said inner casing is sealed with the aid of seals 10 and 11.

At various places, pins 12 have been sealingly guided through the plate 7, and compression springs (not illustrated) may act on said pins. These compression springs press the inner casing 9 against the casing 6 in the axial direction and they thereby pre-stress the inner casing, said prestress being opposed to the stress created by the pressure in the inner casing. Space 14 is in communication with a pressure line 15 at reference numeral 13. A non-return valve 16 with controllable bypass 17 is present in said pressure line 15. The casing 9 is also pre-stressed by the pressure in space 14, said pre-stress being opposed to the internal pressure.

In this manner, pressure surges on the most vulnerable inner casing are transmitted partly directly by the pressure fluid.

It is noted that the axial movability of the inner- and outer casing relative to each other does not mean that there is considerable freedom of movement. The inner casing may even be completely clamped between the walls of the outer casing, provided that the stress therein is independent of any outer influence.

I claim:

1. A pump having an outer casing and an inner casing of a brittle material and of unitary construction, a rotor mounted on a shaft and having an axial fluid passageway, said rotor being disposed in said inner casing, said outer casing comprising a cover surrounding said shaft and a cover surrounding said passageway, said inner casing radially outwardly overlying and axially overlapping both of said covers, and means to introduce a fluid under pressure between said inner and outer casings thereby to place the inner casing in compression to prestress the inner casing in opposition to fluid pressure peaks within the inner casing, said inner casing being of substantially U-shaped cross-sectional configuration with the legs of the U extending into sealed axially sliding contact one with one said cover and the other with the other said cover.

2. A pump as claimed in claim 1, said covers being circular and coaxial with said rotor and with each other and having axially oppositely outwardly directed peripheral flanges against which radially inner edges of said inner cover are in sealed relationship.

* * * * *